US010939732B2

(12) United States Patent
Dong

(10) Patent No.: US 10,939,732 B2
(45) Date of Patent: Mar. 9, 2021

(54) BELT BUCKLE WITH LONG USAGE RATE

(71) Applicant: CCF Cufflink Co., Ltd. Quanzhou, Fujian (CN)

(72) Inventor: Xinrong Dong, Fujian (CN)

( * ) Notice: Subject to any disclaimer, the term of this patent is extended or adjusted under 35 U.S.C. 154(b) by 0 days.

(21) Appl. No.: 16/559,648

(22) Filed: Sep. 4, 2019

(65) Prior Publication Data

US 2021/0022454 A1 Jan. 28, 2021

(30) Foreign Application Priority Data

Jul. 27, 2019 (CN) ..... 201910685349.6

(51) Int. Cl.
*A44B 11/24* (2006.01)

(52) U.S. Cl.
CPC ..... *A44B 11/24* (2013.01)

(58) Field of Classification Search
CPC ..... A44B 11/24; A44B 11/001; A44B 1/006
See application file for complete search history.

(56) References Cited

U.S. PATENT DOCUMENTS 4,406,043 A * 9/1983 Friedman ..... A44B 11/006 24/171
4,419,792 A * 12/1983 Kohli ..... A44B 11/24 24/170
7,480,967 B2 * 1/2009 Kojoori ..... A44B 11/006 2/322
9,173,454 B2 * 11/2015 Liu ..... A44B 11/006
2014/0215766 A1 * 8/2014 Liu ..... A44B 11/006 24/188

* cited by examiner

*Primary Examiner* — Robert Sandy
(74) *Attorney, Agent, or Firm* — Prakash Nama; Global IP Services, PLLC

(57) ABSTRACT

A belt buckle with long usage rate, which includes a buckle body and a mounting member, wherein the left side surface and the right side surface of a mounting rod body are both cutting planes, the left side surface of the mounting member is provided with a through concave cavity, the left end of an upper sheet body and the left end of a lower sheet body are both integrally formed with extension sheets extending downwards, a clamping interval is arranged between the free ends of the two extension sheets, the mounting rod body is clamped into the through concave cavity through the clamping interval and is rotatably arranged in the through concave cavity. The buckle body is detachably connected with the mounting member, so that the free combination of different buckle bodies and different mounting members is realized.

7 Claims, 3 Drawing Sheets

BELT BUCKLE WITH LONG USAGE RATE

BACKGROUND OF THE INVENTION

The invention relates to a clothing wearing accessory, in particular to a belt buckle applied to men's trousers.

The structure of the existing belt consists of a belt body and a belt buckle, wherein the belt buckle has a buckle body and a mounting member, the buckle body is a square frame body enclosed by a four-rod body, and one side of the buckle body is fixedly connected with the mounting member. One side of the mounting member, which is back to the buckle body, is concavely provided with a containing groove for one end of the belt body to extend into the containing groove, and when used, the other end of the belt body extends into the hollow cavity of the buckle body.

As is well known, in case of the existing belt buckle, the buckle body and the mounting member are fixedly connected together, and the belt body and the mounting member are fixedly connected together, so that when the belt body is worn after long-term use, the belt body needs to be discarded together with the belt buckle, and the style of the belt buckle is a fixed style, free combination of different belt buckles cannot be carried out, so that the universality is poor. In this way, consumers have to purchase different styles of belts according to different closings, and the cost is high. At the same time, when the buckle body or mounting member of the belt buckle is damaged, the entire belt buckle should be replaced and discarded, and the non-damaged buckle body or the mounting member cannot be removed and reused, therefore the resource recycling rate is low.

In view of the above, the present inventors have conducted intensive studies to solve the above problems and have made the present invention.

BRIEF SUMMARY OF THE INVENTION

The object of the present invention is to provide a belt buckle with a long usage rate, for solving the problems in the prior art caused by a single style of the belt buckle, namely, high use cost, poor universality, and low resource recycling rate because the whole belt buckle needs to be replaced and discarded when a buckle body or a mounting member is damaged.

In order to achieve the above object, the invention adopts the following technical scheme.

A belt buckle with long usage rate comprises a buckle body and a mounting member, wherein the buckle body is positioned on the left side of the mounting member, the right side of the buckle body is connected with the left side of the mounting member, and the right side of the mounting member is provided with a mounting groove for the belt body to extend into to mount; the right side of the buckle body is provided with a mounting rod body extending along the front-rear direction, the left side surface and the right side surface of the mounting rod body are both cutting planes, the left-right direction width of the mounting rod body is smaller than the up-down direction width of the mounting rod body, the left side of the mounting member is provided with a through concave cavity which extends rightwards and penetrates through the front side and the rear side of the mounting member, the mounting member is provided with an upper sheet body and a lower sheet body at the position of the through concave cavity, the up-down direction width of the through concave cavity is larger than the up-down direction width of the mounting rod body, the left end of the upper sheet body and the left end of the lower sheet body are both integrally formed with extension sheets which extend downwards, there is a clamping interval between the free ends of the two extension sheets, the width of the clamping interval is matched with the left-right direction width of the mounting rod body, and the mounting rod body is clamped into the through concave cavity through the clamping interval and is rotatably arranged in the through concave cavity.

The mounting rod body further comprises a buckle pin, wherein the first end of the buckle pin is rotatably mounted outside the mounting rod body, the second end of the buckle pin extends leftwards to the left side of the buckle body, a hook portion with a hook space is integrally and downwards extended from the end of the first end of the buckle pin, the end of the free end of the hook portion is arranged toward the left, and a buckling interval is provided between the end of the free end of the hook portion and the buckle pin, the left side surface and the right side surface of the middle part of the mounting rod body are both provided with limiting bulges protruding outwards, the thickness of the mounting rod body at the two limiting bulges is matched with the hook space of the hook part, the width of the buckling interval is larger than the left-right direction width of the mounting rod body and smaller than the up-down direction width of the mounting rod, and the left side of the mounting member, at the position corresponding to the buckle pin, is concavely provided with an accommodating recess which is communicated with the through concave cavity and used to accommodate the hook portion and make it be able to rotate.

The upper top surface and the lower bottom surface of the mounting rod body are both convex arc-shaped surfaces, the portion of the mounting rod body at the two limiting bulges is cylindrical, and the width of the buckling interval is smaller than the diameter of the cylindrical portion.

In the front and rear ends of the through concave cavity are both provided with an elastic limiting member which is provided with an upper transverse portion extending along the left-right direction of the mounting member and a lower transverse portion positioned below the upper transverse portion and provided with an interval, the right side of the upper transverse portion and the right side of the lower transverse portion are integrally connected by a U-shaped elbow, the upper transverse portion, the lower transverse portion and the U-shaped elbow form a horizontally arranged U-shaped member in an enclosing way, the interval between the upper transverse portion and the lower transverse portion is gradually increased from left to right, the maximum distance between the upper transverse portion and the lower transverse portion is larger than the distance between the upper sheet body and the lower sheet body, connecting sheets are connected between the front and rear ends of the right side of the upper sheet body and the front and rear ends of the right side of the lower sheet body, the connecting sheets are positioned at the right side of the mounting rod body in the through concave cavity, the opposite surfaces of the two connecting sheets are both convexly provided with a U-shaped convex block lying horizontally in the left-right direction, the cavity bottom of the through concave cavity is positioned at the concave arc-shaped structure, which correspondingly has concave rightwards, of the U-shaped convex block, between the upper top surface of the U-shaped convex block and the upper sheet body, the lower bottom surface of the U-shaped convex block and the lower sheet body, and the U-shaped elbow of the U-shaped convex block and the concave arc-shaped structure respectively form with an interval and form an arc-shaped concave cavity in an enclosing way, the elastic limiting member is elastically compressed and socketed outside the U-shaped convex block and is matched with the arc-shaped concave cavity, the left end of the upper transverse portion and the left end of the lower transverse portion are both positioned outside the left side of the mounting rod body in the through concave cavity, the left end of the upper transverse portion and the left end of the lower transverse portion are provided with limiting bulges which are oppositely arranged, the distance between the two limiting bulges is smaller than the thickness of the mounting rod body positioned on the two cutting planes, and an interval is reserved between the top surface of the upper limiting bulge and the upper sheet body, and an interval is reserved between the bottom surface of the lower limiting bulge and the lower sheet body.

The left side edge of the upper sheet body is provided with an upper arc-shaped chamfer sheet extending downwards, the upper arc-shaped chamfer sheet is an extension sheet of the upper sheet body, the upper arc-shaped chamfer sheet is upwards concavely provided with an upper step at the position of the elastic limiting member, the left side edge of the lower sheet body is provided with a lower arc-shaped chamfer sheet extending upwards, the lower arc-shaped chamfer sheet is an extension sheet of the lower sheet body, the lower arc-shaped chamfer sheet is downwards concavely provided with a lower step at the position of the elastic limiting member, the free end of the upper transverse portion integrally extends to form an upper arc-shaped limiting block, the top surface of which is a concave arc-shaped surface which concave downwardly, the upper arc-shaped limiting block is the limiting bulge of the upper transverse portion, the upper arc-shaped limiting block is corresponding to the upper arc-shaped chamfer sheet, the left side edge of the upper arc-shaped limiting block is positioned at the position of the upper step, and the part of the upper arc-shaped chamfer sheet positioned at the upper step falls into the range of the concave cavity of the upper arc-shaped limiting block; the free end of the lower transverse portion integrally extends to form a lower arc-shaped limiting block, the top surface of which is a convex arc-shaped surface which convex upwardly, the lower arc-shaped limiting block is the limiting bulge of the lower transverse portion, the lower arc-shaped limiting block is corresponding to the lower arc-shaped chamfer sheet, the left edge of the lower arc-shaped limiting block is positioned at the lower step, and the part of the lower arc-shaped chamfer sheet positioned at the lower step falls into the range of the concave cavity of the bottom surface of the lower arc-shaped limiting block.

The buckle body is formed by an enclosure of a four-rod body, the four-rod body are respectively a left rod body, a right rod body, a front rod body and a rear rod body, the right rod body is the mounting rod body, the front rod body and the rear rod body are both arc-shaped rods with narrow left ends and wide right ends, the right rod body is connected between the lower portion of the right side of the front rod body and the lower portion of the right side of the rear rod body, the upper right portion of the front rod body and the upper right portion of the rear rod body are integrally formed with a belt rod located above the right side of the mounting member, and a passing interval for the belt body to pass through is reserved between the belt rod and the top surface of the mounting member.

The mounting rod body is arranged in a leftward or rightward inclined mode, and the inclined angle of the mounting rod body is 5-10 degrees.

By adopting the technical scheme, the belt buckle with long usage rate according to the present invention utilizes the cutting planes on the left side surface and the right side surface of the mounting rod body. When mounted, the mounting rod body is in a vertical state, and the two cutting planes are arranged in the up-down direction, then the mounting rod body can be clamped into the through concave cavity from the clamping interval in a straight and tight fit manner by pushing with a slight force because the left-right direction width of the mounting rod body is matched with the clamping interval, then the buckle body is rotated to enable the buckle body to be in a straight state, at the moment, the mounting rod body is not prone to sliding out of the through concave cavity because the up-down direction width of the mounting rod body is larger than the clamping interval, so that the mount of the buckle body and the mounting member is completed; correspondingly, the mounting rod body is erected again, then the mounting rod body can be released from the through concave cavity by pulling straightly and outwards with a slight force, thereby achieving the separation of the buckle body from the mounting member.

Compared with the prior art, the belt buckle with long usage rate has the following beneficial effects:

first, when the whole belt buckle cannot be discarded while the buckle body or the connecting member is damaged, the buckle body and the connecting member can be separated, and the intact connecting member or the intact buckle body is reserved for recycling, so that resources are effectively utilized, the usage rate of the belt buckle is greatly improved, the repeated recycling of the buckle or the connecting member is realized, and the use cost of a consumer is reduced;

second, when one side of the belt body is damaged, the buckle body can be detached to turn over the belt body and then combine the belt body with the buckle body, so that the other side of the belt body can be used, thereby achieving double-side use, and greatly prolonging the service life of the belt;

third, during the using process, the buckle bodies and the connecting member with different colors or styles can be freely combined and used to combine the belt buckles with different styles, so that the universality is high, the use is flexible, and the use pleasure of the belt buckle is increased, at the same time, when purchasing, consumers only need to buy one belt body and multiple buckle bodies or multiple belt body with different colors or styles and one buckle body to combine to form different styles of belt, and not need to match one buckle body for each belt body, which greatly saves the cost of use; and fourth, the integral structure is simple and easy, so that the processing and the manufacturing are simple, meanwhile, other tools are not needed to assist when disassembling and assembling, and the disassembly and the assembly can be directly carried out by bare hands, so that the use is convenient.

DETAILED DESCRIPTION OF THE INVENTION

For further explanation of the technical solution of the present invention, the following detailed description is made with reference to the accompanying drawings.

Figure 1:
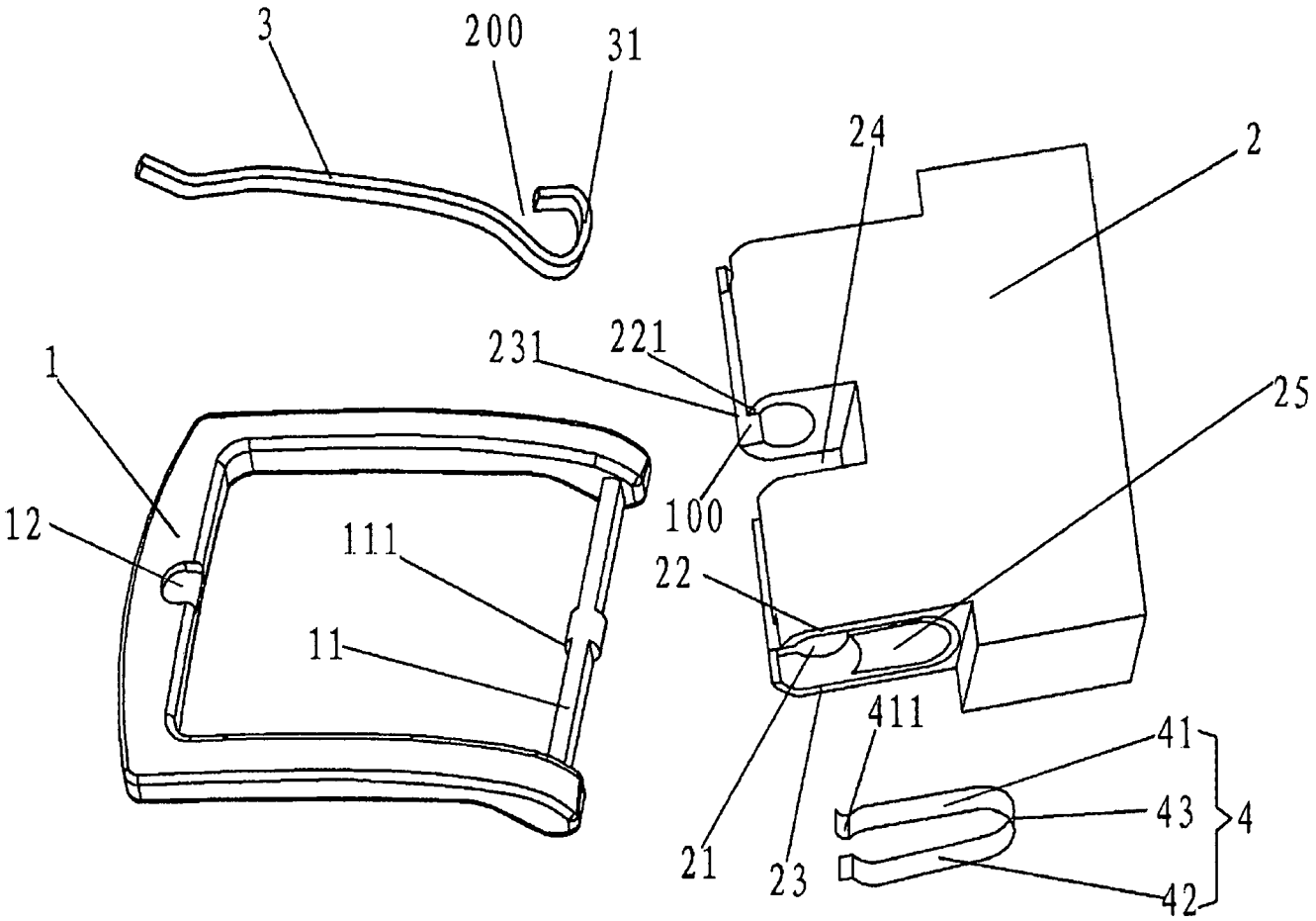
FIG. 1 is a schematic structural view of the present invention.
Figure 2:
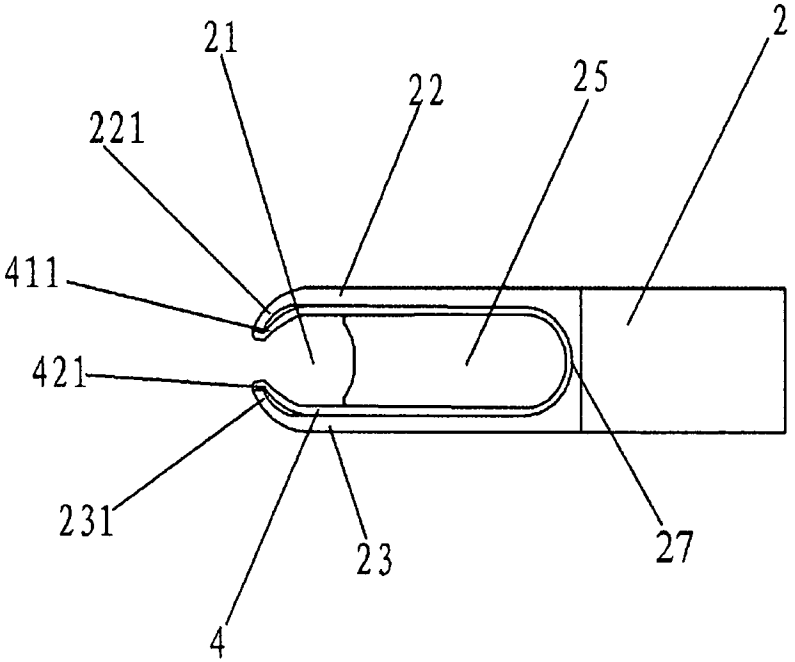
FIG. 2 is a schematic view showing the combination of the mounting member and the elastic limiting member according to the present invention.

As shown in FIGS. 1-2, a belt buckle with long usage rate according to the present invention comprises a buckle body 1, a mounting member 2 and a buckle pin 3, wherein the buckle body 1 is a hollow square frame body formed by an enclosure of a four-rod body which is arranged in a front, back, left-right mode. The four-rod body is formed by integral die casting. The four-rod body is divided into a front rod body, a back rod body, a left rod body and a right rod body. The lower end of the right side of the front rod body extends downwards to form a lug, and the lower end of the right side of the back rod body extends downwards to form a lug, namely the widths of the front rod body and the back rod body are gradually expanded from left to right, and the right rod body is connected between the two lugs.

The buckle pin 3 adopts the existing structure. The first end of the buckle pin 3 is rotatably mounted outside the right rod body of the buckle body 1, and the right rod body is used as a mounting rod body 11. The second end of the buckle pin 3 extends leftwards to the rod body opposite to the mounting rod body 11. A concave notch 12 for accommodating the end portion of the second end of the buckle pin 3 is formed in the right side of the front surface of the rod body on the left side. The mounting rod body 11 is mounted on the left side of the mounting member 2, and the mounting member 2 is a square block body. A mounting groove (not shown in the figure) for the belt body to extend into to mount inside is formed in the right side surface of the mounting member 2. When used, one end of the belt body extends into the mounting groove, and then a screw is adopted to insert into the mounting groove to lock it.

The left side surface and the right side surface of the mounting rod body 11 are both cutting planes, and the front side surface and the rear side surface of the mounting rod body 11 are both cambered surfaces. The up-down direction width of the mounting rod body 11 is larger than the horizontal direction width of the mounting rod body 11, namely, the width of the left side surface is larger than that of the front side surface. The left side surface of the mounting member 2 is provided with a through concave cavity 21 which extends rightwards and penetrates through the front side and the rear side of the mounting member 2. The cavity bottom of the through the concave cavity 21 (namely, the right inner cavity wall of the through concave cavity 21) is a concave arc-shaped surface, and the mounting member 2 is provided with an upper sheet body 22 and a lower sheet body 23 at the position of the through concave cavity 21. The up-down direction width of the through concave cavity 21 is larger than the up-down direction width of the mounting rod body 11, namely, the mounting rod body 11 can movably rotate in the through concave cavity 21. The left end of the upper sheet body 22 and the left end of the lower sheet body 23 are both integrally formed with an extension sheet 221 and 231 which extend downwards. There is a clamping interval 100 between the free ends of the two extension sheets 221 and 231, and the width of the clamping interval 100 is matched with the left-right direction width of the mounting rod body 11, namely, just for the mounting rod body 11 to clamp in. The mounting rod body 11 is clamped into the through concave cavity 21 through the clamping interval and is rotatably arranged in the through concave cavity 21. The left side of the mounting member 2, at the position corresponding to the first end of the buckle pin 3, is concavely provided with an accommodating recess 24, which is communicated with the through concave cavity 21 and used to receive the part of the buckle pin positioned at the mounting member and make it be able to rotate, that is, a square groove is rightwards concavely arranged in the middle of the left side surface of the mounting member 2, and the square groove penetrates through the upper end surface and the lower end surface of the mounting member 2, namely, the first end of the buckle pin 3 rotates up and down in the square groove.

The belt buckle with long usage rate according to the present invention utilizes the cutting planes on the left side surface and the right side surface of the mounting rod body 11. When mounted, the mounting rod body 11 is in a vertical state, and the two cutting planes are arranged in the up-down direction, then the mounting rod body 11 can be clamped into the through concave cavity 21 from the clamping interval 100 in a straight and tight fit manner by pushing with a slight force because the left-right direction width of the mounting rod body 11 is matched with the clamping interval 100, then the buckle body is rotated to enable the buckle body to be in a straight state, at the moment, the mounting rod body is not prone to sliding out of the through concave cavity because the up-down direction width of the mounting rod body is larger than the clamping interval, so that the mount of the buckle body and the mounting member is completed; correspondingly, the mounting rod body is erected again, then the mounting rod body can be released from the through concave cavity by pulling straight outward with a slight force, thereby achieving the separation of the buckle body from the mounting member.

Compared with the prior art, the belt buckle with long usage rate has the following beneficial effects:

first, when the whole belt buckle cannot be discarded while the buckle body or the connecting member is damaged, the buckle body and the connecting member can be separated, and the intact connecting member or the intact buckle body is reserved for recycling, so that resources are effectively utilized, the usage rate of the belt buckle is greatly improved, the repeated recycling of the buckle or the connecting member is realized, and the use cost of a consumer is reduced;

second, when one side of the belt body is damaged, the buckle body can be detached to turn over the belt body and then combine the belt body with the buckle body, so that the other side of the belt body can be used, thereby achieving double-side use, and greatly prolonging the service life of the belt;

third, during the using process, the buckle bodies and the connecting member with different colors or styles can be freely combined and used to combine the belt buckles with different styles, so that the universality is high, the use is flexible, and the use pleasure of the belt buckle is increased, at the same time, when purchasing, consumers only need to buy one belt body and multiple buckle bodies or multiple belt body with different colors or styles and one buckle body to combine to form different styles of belt, and not need to match one buckle body for each belt body, which greatly saves the cost of use; and fourth, the integral structure is simple and easy, so that the processing and the manufacturing are simple, meanwhile, other tools are not needed to assist when disassembling and assembling, and the disassembly and the assembly can be directly carried out by bare hands, so that the use is convenient.

In the present invention, preferably, a hook portion 31 with a hook space is integrally and downwards extended from the first end of the buckle pin 3. The free end of the hook portion 31 is arranged toward the left, and a buckling interval 200 is provided between the end of the free end of the hook portion and the buckle pin. The structure of the hook portion 31 is an existing structure, and the left side surface and the right side surface of the middle portion of the mounting rod body 11 are both provided with limiting bulges 111 protruding outwards. The thickness of the mounting rod body at the two limiting bulges is matched with the hook space of the hook portion. Preferably, the portion of the mounting rod body 11 at the two limiting bulges is cylindrical. The width of the buckling interval is larger than the left-right direction width of the mounting rod body and smaller than the up-down direction width of the mounting rod, namely, the width of the buckling interval 200 is larger than the clamping interval 100. The hollow space of the hook portion 31 is matched with the part of the mounting rod body 11 at the cylindrical portion, thus, the buckle body 1 is in a vertical state, and the mounting rod body 11 can be buckled from the buckling interval to enable the buckle pin 3 to be hung on the mounting rod body 11, then the buckle body 1 rotates to a straight state and translates to the cylindrical portion. The two limiting bulges 111 are together positioned in the hook portion 31, and the clamping space is smaller than the diameter of the cylindrical portion, so that the hook portion 31 will not be released from the mounting rod body 1 when used, and the hook portion 31 is positioned in the accommodating recess 24, therefore the accommodating recess 24 can be used to limit the buckle pin 3 to move left-right on the mounting rod body 11. Through the above-mentioned scheme, the buckle pin 3 can be replaced, then, the buckle body, the mounting member and the buckle pin can be freely assembled and disassembled. In this way, two belt buckles can be freely combined to form belt buckles of different styles, so that the use is more flexible, and the commonality is stronger, thereby further strengthening the use decorative and commonality of belt buckle.

Further preferably, in the front and rear ends of the through concave cavity 21 are both provided with an elastic limiting member 4. The elastic limiting member 4 is made of rigid material and is a rigid member. The elastic limiting member 4 is provided with an upper transverse portion 41 extending along the left-right direction of the mounting member and a lower transverse portion 42 positioned below the upper transverse portion and provided with an interval. The right side of the upper transverse portion 41 and the right side of the lower transverse portion 42 are integrally connected by a U-shaped elbow 43, and the upper transverse portion 41, the lower transverse portion 42 and the U-shaped elbow 43 form a horizontally arranged U-shaped member in an enclosing way. Because the upper transverse portion and the lower transverse portion have a certain interval, they can be relatively extruded and pressed to generate a certain elasticity. The interval between the upper transverse portion 41 and the lower transverse portion 42 is gradually increased from left to right, namely, the two members of the U-shaped member are in a non-straight structure. The maximum distance between the upper transverse portion 41 and the lower transverse portion 42 is larger than the distance between the upper sheet body 22 and the lower sheet body 23, that is, when being laid horizontally, the elastic limiting member 4 cannot be clamped into the through concave cavity 21, and can be clamped into the through concave cavity 21 only after being pressed, so that the elastic limiting member 4 cannot fall out of the through concave cavity 21.

Connecting members (not shown in the figure) are connected between the front end of the right side of the upper sheet body 22 and the front end of the right side of the lower sheet body 23 and between the rear end of the right side of the upper sheet body 22 and the rear end of the right side of the lower sheet body 23. The connecting members are positioned on the right side of the mounting rod body 11 in the through concave cavity, namely, the left side of the through concave cavity 21 is used for accommodating the rod body 11. The front end and the rear end of the right side of the through concave cavity 21 are respectively provided with a connecting sheet, and the opposite surfaces of the two connecting sheets are both convexly provided with a U-shaped convex block 25 lying horizontally in the left-right direction. The upper top surface and the lower top surface of the U-shaped convex block 25 are both flat surfaces. The U-shaped elbow of the U-shaped convex block 25 is positioned at the right side. The cavity bottom of the through concave cavity is positioned at the concave arc-shaped structure 27, which correspondingly has concave rightwards, of the U-shaped convex block 25. Between the upper top surface of the U-shaped convex block and the upper sheet body, the lower bottom surface of the U-shaped convex block and the lower sheet body, and the U-shaped elbow and the concave arc-shaped structure respectively form with an interval and form an arc-shaped concave cavity in an enclosing way, namely, an upper interval is reserved between the top surface of the U-shaped convex block and the upper sheet body, a lower interval is reserved between the bottom surface of the U-shaped convex block and the lower sheet body, and a right interval is reserved between the right side surface of the U-shaped convex block and the right side surface of the through concave cavity. The upper interval, the lower interval and the right interval are communicated to form an U-shaped channel. The width of the U-shaped channel is matched with the thickness of the elastic limiting member 4. The U-shaped channel is positioned on the surfaces of the two connecting sheets which are opposite to each other, namely, the U-shaped channel is communicated with the side opening of the through concave cavity. The elastic limiting member 4 is elastically compressed and socketed outside the U-shaped convex block 25 and matched with the arc-shaped concave cavity, namely, when the upper transverse portion 41 and the lower transverse portion 42 are pressed relatively, the upper transverse portion 41 and the lower transverse portion 42 are directly pressed into the arc-shaped concave cavity from the side opening of the through concave cavity. Because the width of the U-shaped channel is matched with the thickness of the elastic limiting member 4, namely, the upper transverse portion is clamped between the upper transverse portion and the top surface of the U-shaped convex block, the lower transverse portion is clamped between the lower transverse portion and the bottom surface of the U-shaped convex block, and the left end of the upper transverse portion 41 and the left end of the lower transverse portion 42 are both positioned outside the left side of the mounting rod body 11 in the through concave cavity, namely, the left ends of the upper transverse portion 41 and the lower transverse portion 42 extend to the cavity opening of the through concave cavity. The left end of the upper transverse portion 41 and the left end of the lower transverse portion 42 are provided with limiting bulges which are oppositely arranged. The distance between the two limiting bulges is smaller than the thickness of the mounting rod body 11 positioned on the two cutting planes, and an interval is reserved between the top surface of the upper limiting bulge and the upper sheet body, and an interval is reserved between the bottom surface of the lower limiting bulge and the lower sheet body, so that the portions of the elastic limiting member 4 at the two limiting bulges can be opened back to back by utilizing the intervals; when the mounting rod body 11 is clamped into the through concave cavity by means of the elastic limiting member 4 and then moves to the two limiting bulges, the mounting rod body 11 is strongly force the upper transverse portion and the lower transverse portion to open back to back and slide into the interval between the upper transverse portion and the lower transverse portion of the elastic limiting member 4. The two limiting bulges are correspondingly and elastically reset, the mounting rod body is positioned in the range between the limiting bulges and the U-shaped convex block, and meanwhile, the interval between the two limiting bulges is smaller than the thickness of the mounting rod body, so that the mounting rod body is further limited from being separated from the mounting member 2, and the use reliability is better. Also, the structure of the elastic limiting member 4 is easy to disassemble, assemble and replace for the whole buckle body, so that the use is convenient, each component can be replaced separately after being damaged, and the usage rate of buckle body can be improved progressively.

The left side edge of the upper sheet body 22 is provided with an upper arc-shaped chamfer sheet 221 extending downwards, the upper arc-shaped chamfer sheet is an extension sheet of the upper sheet body, and the upper arc-shaped chamfer sheet is upwards concavely provided with an upper step at the upper transverse portion of the elastic limiting member 4. The left side edge of the lower sheet body 23 is provided with a lower arc-shaped chamfer sheet 231 extending upwards, the lower arc-shaped chamfer sheet is an extension sheet of the lower sheet body, and the lower arc-shaped chamfer sheet is downwards concavely provided with a lower step at the lower transverse portion of the elastic limiting member 4. The free end of the upper transverse portion 41 integrally extends to form an upper arc-shaped limiting block 411, the top surface of which is a concave arc-shaped surface which concaves downwardly. The upper arc-shaped limiting block 411 is corresponding to the upper arc-shaped chamfer sheet. The left side edge of the upper arc-shaped limiting block 411 is positioned at the upper step, the part of the upper arc-shaped chamfer sheet positioned at the upper step falls into the range of the concave cavity of the upper arc-shaped limiting block, and an interval is reserved between the part of the upper arc-shaped chamfer sheet positioned at the upper step and the cavity bottom of the concave cavity of the upper arc-shaped limiting block. The free end of the lower transverse portion 42 integrally extends to form a lower arc-shaped limiting block 421, the top surface of which is a convex arc-shaped surface which convex upwardly. The lower arc-shaped limiting block 421 is corresponding to the lower arc-shaped chamfer sheet. The left side edge of the lower arc-shaped limiting block 421 is positioned at the lower step, the part of the lower arc-shaped chamfer sheet positioned at the lower step falls into the range of the concave cavity at the bottom surface of the lower arc-shaped limiting block, and an interval is reserved between the part of the lower arc-shaped chamfer sheet positioned at the lower step and the cavity bottom of the concave cavity of the lower arc-shaped limiting block. The structures of the upper arc-shaped limiting block and the lower arc-shaped limiting block are the limiting bulges. The elastic limiting member 4 of the above structure make the mounting rod body move in smoothly, it is not affected by the two limiting blocks to not easy to clamp into the through concave cavity, and the limit of the elastic limiting member 4 to the mounting rod body can be ensured.

Figure 3:
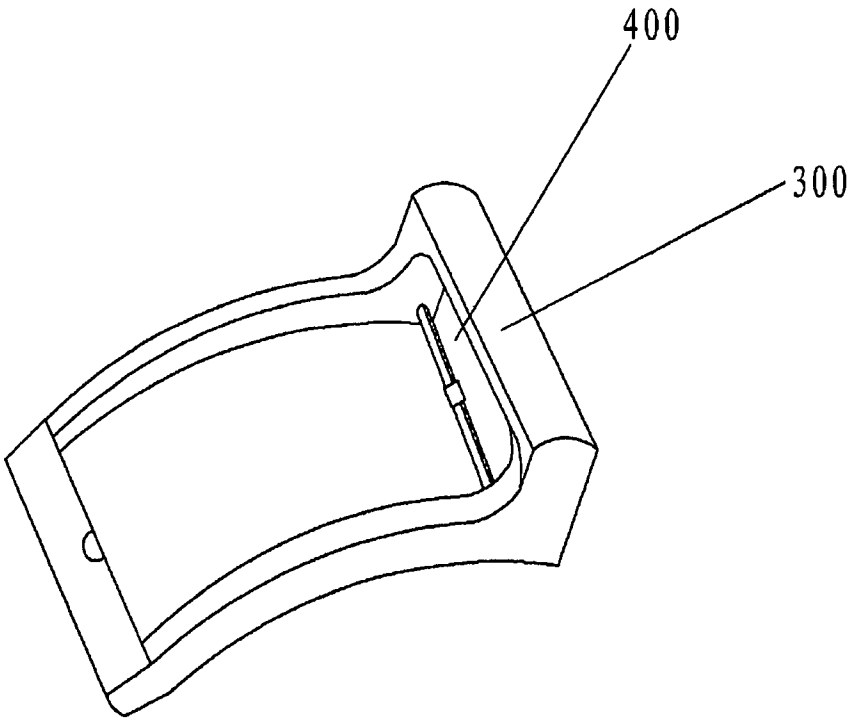
FIG. 3 is a schematic structural view of another buckle body according to the present invention.

Further preferably, as shown in FIG. 3, the front rod body and the rear rod body are both arc-shaped rods with narrow left ends and wide right ends, a right rod body is connected between the lower right portion of the front rod body and the lower right portion of the rear rod body, the upper right portion of the front rod body and the upper right portion of the rear rod body are integrally formed with a belt rod 300 located above the right side of the mounting member, and a passing interval 400 for the belt body to pass through is reserved between the belt rod and the top surface of the mounting member; through the belt rod, the mounting member is not required to be provided with a belt loop for the belt body to pass through and limit, so that the structure is simpler.

In the present invention, the mounting rod body 11 is arranged in a leftward or rightward inclined manner, and the inclined angle of the mounting rod body 11 is 5-10 degrees, so that the cutting plane is an inclined structure through the mounting rod body 11. In this way, the interior of the mounting rod body 11 is not easy to separate from the through concave cavity, and the use stability is ensured again.

In the present invention, the structure of the buckle body is not limited to the square buckle body of the present embodiment, but the buckle body of other shapes is also applicable.

The belt buckle according to the invention can also be applied to a plate type belt buckle, namely, the buckle body is a plate body. When applied to the plate type belt buckle, it is not needed to additionally arrange a buckle pin. The left side of the bottom surface of the buckle body is provided with a positioning pin which extends downwards to pass through a belt body positioning hole, and the mounting rod body is arranged on the right side of the bottom surface of the buckle body, so that the disassembly and assembly operation of the plate type buckle body and a connecting member can also be realized.

The product forms of the present invention are not limited to the illustrations and examples herein, and any appropriate changes or modifications in similar manners should be construed as being within the scope of the present invention.

What is claimed is:

1. A belt buckle, comprising a buckle body and a mounting member, wherein the buckle body is positioned on a left side of the mounting member, a right side of the buckle body is connected with the left side of the mounting member, and a belt body is mounted to a right side of the mounting member; wherein the right side of the buckle body is provided with a mounting rod body extending along a front-rear direction, a left side surface and a right side surface of the mounting rod body are both cutting planes, a left-right direction width of the mounting rod body is smaller than an up-down direction width of the mounting rod body, the left side of the mounting member is provided with a through concave cavity which extends rightwards and penetrates through a front side and a rear side of the mounting member, the mounting member is provided with an upper sheet body and a lower sheet body at a position corresponding to the through concave cavity, an up-down direction width of the through concave cavity is larger than the up-down direction width of the mounting rod body, a left end of the upper sheet body and a left end of the lower sheet body are formed with an upper arc-shaped chamfer sheet and a lower arc-shaped chamfer sheet respectively extending towards each other, there is a clamping interval between free ends of the upper arc-shaped chamfer sheet and the lower arc-shaped chamfer sheet, a width of the clamping interval matches with the left-right direction width of the mounting rod body, and the mounting rod body is clamped into the through concave cavity through the clamping interval and is rotatably arranged in the through concave cavity.

2. The belt buckle according to claim 1, characterized in that: the mounting rod body further comprises a buckle pin, wherein a first end of the buckle pin is rotatably mounted outside the mounting rod body, a second end of the buckle pin extends leftwards to a left side of the buckle body, a hook portion with a hook space is integrally formed with and extended from the first end of the buckle pin, a free end of the hook portion is arranged toward the left side of the buckle body, and a buckling interval is provided between the free end of the hook portion and the buckle pin, a left side surface and a right side surface of a middle part of the mounting rod body are each provided with a limiting bulge which protrudes outwardly from the mounting rod body, a thickness of the mounting rod body at the two limiting bulges matches with the hook space of the hook portion, a width of the buckling interval is larger than the left-right direction width of the mounting rod body and smaller than the up-down direction width of the mounting rod body, and the left side of the mounting member is concavely provided with an accommodating recess corresponding to the buckle pin, the accommodating recess is communicated with the through concave cavity to receive the hook portion so that the hook portion is rotatable in the accommodating recess.

3. The belt buckle according to claim 2, characterized in that: an upper top surface and a lower bottom surface of the mounting rod body are both convex arc-shaped surfaces, a portion of the mounting rod body at the two limiting bulges is a cylindrical portion, and the width of the buckling interval is smaller than a diameter of the cylindrical portion.

4. The belt buckle according to claim 1, characterized in that: a front end and a rear end of the through concave cavity are each provided with an elastic limiting member each comprising an upper transverse portion extending along a left-right direction of the mounting member and a lower transverse portion positioned below the upper transverse portion, and an interval exists between the upper transverse portion and the lower transverse portion of each elastic limiting member, a right side of the upper transverse portion and a right side of the lower transverse portion of each elastic limiting member are integrally connected by a U-shaped elbow, the upper transverse portion, the lower transverse portion and the U-shaped elbow of each elastic limiting member form a horizontally arranged U-shaped member, the interval between the upper transverse portion and the lower transverse portion of each elastic limiting member gradually increases from an opening of the U-shaped member to the U-shaped elbow, a maximum distance between the upper transverse portion and the lower transverse portion of each elastic limiting member is larger than a distance between the upper sheet body and the lower sheet body; each elastic limiting member is elastically compressed on a U-shaped convex block lying horizontally in a left-right direction, a cavity bottom of the through concave cavity is configured as a concave arc-shaped structure; the concave arc-shaped structure is concaved rightwards corresponding to a U-shaped elbow of each U-shaped convex block; an arc-shaped concave cavity adjacent to each U-shaped convex block is defined by gaps between an upper top surface of the corresponding U-shaped convex block and the upper sheet body, between a lower bottom surface of the corresponding U-shaped convex block and the lower sheet body, and between the U-shaped elbow of the corresponding U-shaped convex block and the concave arc-shaped structure of the cavity bottom of the through concave cavity, and each elastic member is socketed in the corresponding arc-shaped concave cavity such that each elastic limiting member is elastically compressed on the corresponding U-shaped convex block; a left end of the upper transverse portion and a left end of the lower transverse portion of each of the elastic limiting members are both positioned leftwards with respect to the mounting rod body in the through concave cavity, the left end of the upper transverse portion of each of the elastic limiting members is provided with an upper limiting bulge, and the left end of the lower transverse portion of each of the elastic limiting members is provided with a lower limiting bulge; the upper limiting bulge and the lower limiting bulge of each of the elastic limiting members are oppositely arranged, a distance between the upper limiting bulge and the lower limiting bulge of each of the elastic limiting members is smaller than a thickness of the mounting rod body between the two cutting planes, and an interval is reserved between a top surface of the upper limiting bulge of each of the elastic limiting members and the upper sheet body, and an interval is reserved between a bottom surface of the lower limiting bulge of each of the elastic limiting members and the lower sheet body.

5. The belt buckle according to claim 4, characterized in that: the upper arc-shaped chamfer sheet is an extension sheet of the upper sheet body, the upper arc-shaped chamfer sheet is provided with an upper step corresponding to both of the elastic limiting members, the lower arc-shaped chamfer sheet is an extension sheet of the lower sheet body, the lower arc-shaped chamfer sheet is provided with a lower step corresponding to both of the elastic limiting members, a free end of the upper transverse portion of each elastic limiting member integrally extends to form the upper limiting bulge which is an upper arc-shaped limiting block, a top surface of the upper arc-shaped limiting block is a concave arc-shaped surface, the upper arc-shaped limiting block is corresponding to the upper arc-shaped chamfer sheet, a left side edge of the upper arc-shaped limiting block of each elastic limiting member is positioned corresponding to the upper step of the upper arc-shaped chamfer sheet, and a part of the upper arc-shaped chamfer sheet at the upper step falls into the concave arc-shaped surface of the upper arc-shaped limiting block of each elastic limiting member; a free end of the lower transverse portion of each elastic limiting member integrally extends to form the lower limiting bulge which is a lower arc-shaped limiting block, a top surface of the lower arc-shaped limiting block is a convex arc-shaped surface, the lower arc-shaped limiting block is corresponding to the lower arc-shaped chamfer sheet, a left side edge of the lower arc-shaped limiting block is positioned corresponding to the lower step of the lower arc-shaped chamfer sheet, and a part of the lower arc-shaped chamfer sheet at the lower step falls into a concave cavity of a bottom surface of the lower arc-shaped limiting block.

6. The belt buckle according to claim 1, characterized in that: the buckle body is formed by an enclosure of a four-rod body, the four-rod body comprises a left rod body, a tight rod body, a front rod body and a rear rod body, the right rod body is the mounting rod body, the front rod body and the rear rod body are both arc-shaped rods with narrow left ends and wide right ends, the right rod body is connected between a lower portion of a right side of the front rod body and a lower portion of a right side of the rear rod body, an upper right portion of the front rod body and an upper right portion of the rear rod body are integrally formed with a belt rod, and a passing interval for the belt body to pass through is reserved between the belt rod and a top surface of the mounting member.

7. The belt buckle according to claim 1, characterized in that: the mounting rod body is arranged in a leftward or rightward inclined mode, and an inclined angle of the mounting rod body is 5-10 degrees.

* * * * *